US005437247A

United States Patent [19]

Dubil et al.

[11] Patent Number: 5,437,247

[45] Date of Patent: Aug. 1, 1995

[54] DROP DOWN CORBELLING (LAW029)

[75] Inventors: Robert F. Dubil, Chester; John R. Peterson, Randolph, both of N.J.

[73] Assignee: Exxon Research and Engineering Company, Florham Park, N.J.

[21] Appl. No.: 225,031

[22] Filed: Apr. 8, 1994

[51] Int. Cl.[6] ..... F22B 9/04

[52] U.S. Cl. ..... 122/44.2; 122/155.2; 122/367.2; 165/172

[58] Field of Search ..... 122/367.1, 367.2, 44.2, 122/155.2, 235.17; 165/172, 160, 903

[56] References Cited

U.S. PATENT DOCUMENTS

| | | | |
|---|---|---|---|
| 2,184,345 | 12/1939 | Hersey | 165/172 |
| 2,205,984 | 6/1940 | Kromas | 165/172 |
| 3,111,168 | 11/1963 | Huet | 165/172 |
| 3,476,180 | 11/1969 | Straight, Jr. et al. | 165/172 |
| 3,958,951 | 4/1976 | Woebcke et al. | 23/288 |
| 3,999,600 | 12/1976 | Bell | 165/78 |
| 4,064,866 | 12/1977 | Knight, Jr. | 165/172 |
| 4,142,578 | 3/1979 | Smith | 165/81 |
| 4,241,232 | 12/1980 | Gelsing | 373/138 |
| 4,327,671 | 5/1982 | Zimmer, Jr. | 122/44.2 |
| 4,619,314 | 10/1986 | Shimoda | 165/104.16 |
| 4,809,645 | 3/1989 | Fournier et al. | 122/6 A |
| 4,957,160 | 9/1990 | Raleigh | 165/160 |
| 4,986,222 | 1/1991 | Pickell et al. | 122/6 R |
| 5,094,292 | 3/1992 | Buckshaw | 165/134.1 |
| 5,154,648 | 10/1992 | Buckshaw | 165/134.1 |
| 5,163,508 | 11/1992 | Hamos | 165/160 |

*Primary Examiner*—Willis R. Wolfe
*Attorney, Agent, or Firm*—Joseph J. Dvorak; Roy J. Ott

[57] ABSTRACT

The present invention provides a mechanism device for preventing gas channeling between the sidewall and a heat exchange tube bundle located in the convection section of a horizontal tube fired heater while permitting in-situ repair of the sidewall refractory. The invention comprises a plurality of serially elongated plate members pivotably mounted on a tube and sized longitudinally to extend at a predetermined distance from the tube to the sidewall of the convection section of the heater, the number of plate members being sufficient to extend for substantially the length of the tube.

4 Claims, 4 Drawing Sheets

DROP DOWN CORBELLING (LAW029)

FIELD OF THE INVENTION

This invention relates to fired heaters having rows of heat exchanger tubes horizontally disposed in a convection section of the heater.

BACKGROUND OF THE INVENTION

There are a wide variety of fired heaters used in refinery and chemical processing units. These can be classified in various ways. For example, they can be classified according to the heat exchanger mechanisms, i.e., whether the heaters consist solely of a radiant section or includes a convection section. The heater can also be classified according to the arrangement of the heat exchange tubes, i.e., whether they are arranged horizontally or vertically within the heater.

The present invention is concerned with heaters which have a separate convection section above a radiant section and which convection section contains rows of heat exchange tubes horizontally disposed within the convection section. Such fired heaters as generally referred to as horizontal tube fired heaters. In such heaters corbelling is used to prevent gas bypassing between the side wall and the tubes disposed in the convection section of the heater. Typically the corbelling is a fixed rigid member constructed of steel or refractory that is attached to and extends horizontally outwardly from the sidewall of the convection section of the heater. Unfortunately, the corbelling obstructs modular placement of tube bundles within the convection section of the heater. Also, the corbelling severely limits in situ repair of the sidewall refractory.

It is an object of the present invention to provide a corbelling which overcomes the deficiencies of the corbelling of the prior art.

SUMMARY OF THE INVENTION

The present invention provides a mechanism or device for preventing gas channeling between the sidewall and a heat exchange tube bundle located in the convection section of a horizontal tube fired heater while permitting in-situ repair of the sidewall refractory. The invention comprises a plurality of serially elongated plate members pivotably mounted on a tube and sized longitudinally to extend at a predetermined distance from the tube to the sidewall of the convection section of the heater, the number of plate members being sufficient to extend for substantially the length of the tube.

In one embodiment of the present invention, each of the elongated plate members is pivotably mounted on a horizontally disposed tube by means of at least two mounting members comprising a first part of arcuate section sized to fit over the tube in slideable engagement therewith and having an arm extending radially outward from the first part.

In another embodiment of the present invention each of the elongated plate members is pivotably mounted to a tube stud by hinge means.

DETAILED DESCRIPTION OF THE INVENTION

Figure 2:
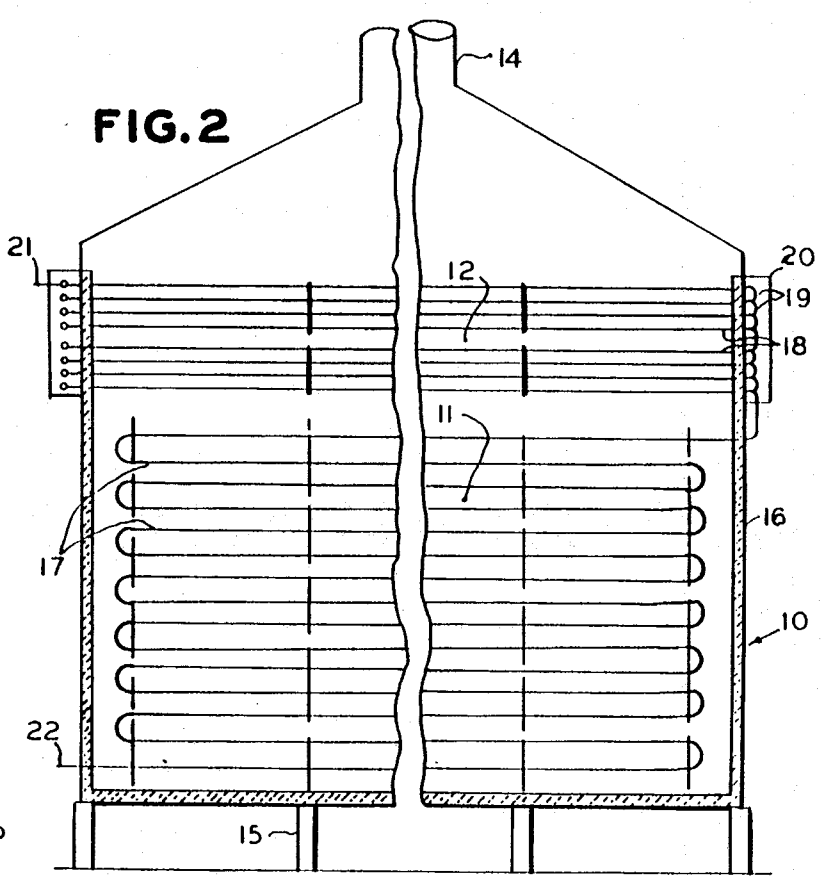
FIG. 2 is a diagramatic side view of a horizontal tube fired heater showing the horizontally disposed tubes in the convection section of the heater.
Figure 1:
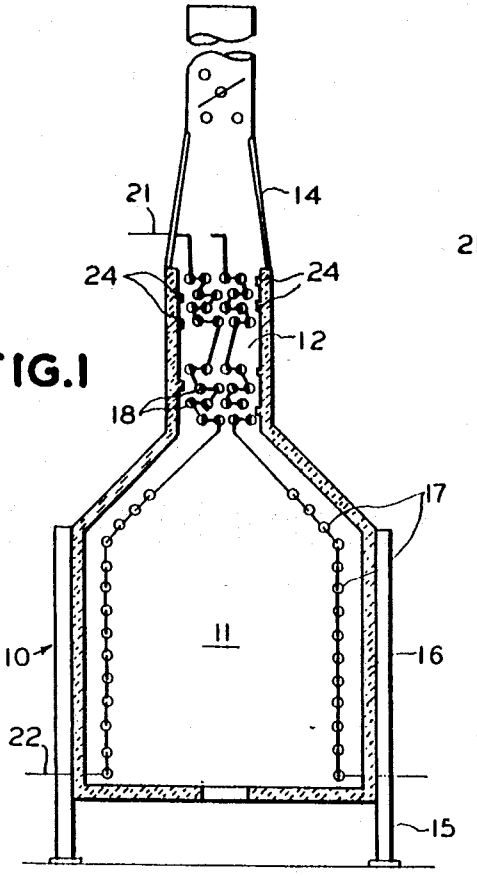
FIG. 1 is a diagramatic end view of a horizontal tube fired heater employing the corbelling of the prior art in the convection section of the heater.

The invention will now be described with particular reference to fired heaters of the type having horizontally disposed heat exchange tubes and a convection section of the heater. A typical design of such a heater is shown in FIGS. 1 and 2. As shown, a horizontal tube fire heater 10 has a radiant section 11 and a convection section 12 positioned above the radiant section 11. The convection section 12 generally has a smaller cross-sectional area than the radiant section 11. Above the convention section 12 is a upright stack 14. The furnace is supported by a plurality of standards 15. Burners (not shown) are centrally located at the base of the radiant section 11. A refractory material 16 is used to line the walls and floor of the radiant section 11 and convection section 12. Rows of radiant heat exchange tubes 17 are located within the radiant section 11 of the heater 10. Positioned above the radiant furnace tubes 17 in the convection section 12 are the horizontally disposed convection tubes 18. These tubes 18 are connected by 180° return bends 19 which, as can be seen in FIG. 2, are located in header box 20. Thus, as can be seen in FIG. 2, the convection tubes 18 form a continuous coil as do tubes 17. Additionally, tubes 17 and 18 are in communication with each other and in communication with a coil inlet 21 and a coil outlet 22.

As can be seen in the prior art heater shown in FIG. 1, corbelling 24 is provided in the convection section 12 of the heater 10 thereby preventing channeling of the gas in the heater. The present invention is an improvement in the corbelling used in horizontal tube fired heater as will be explained in greater detail in connection with the remaining figures.

Figure 3:
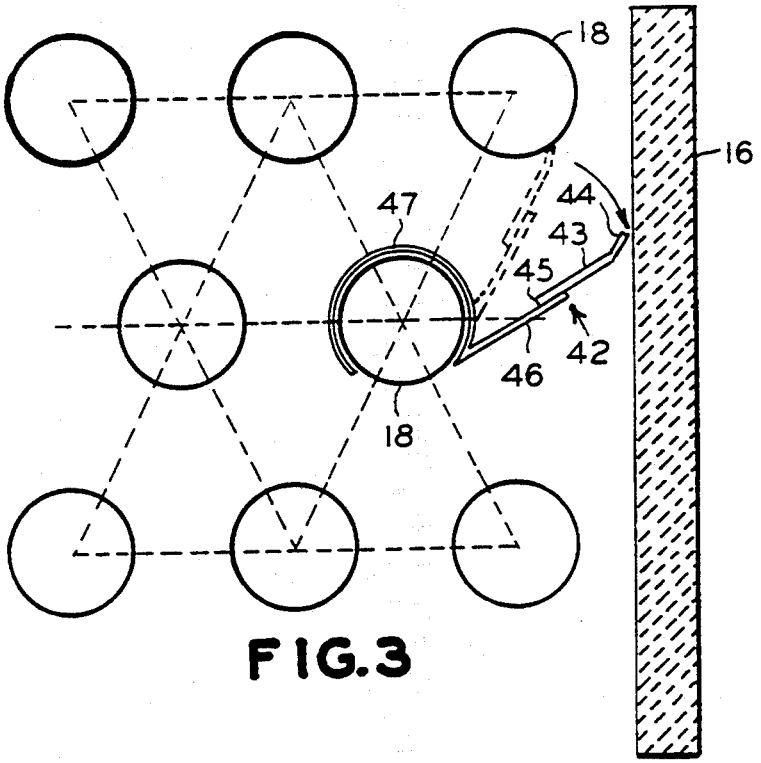
FIG. 3 is a detailed view showing one embodiment of a device of the present invention.
Figure 6:
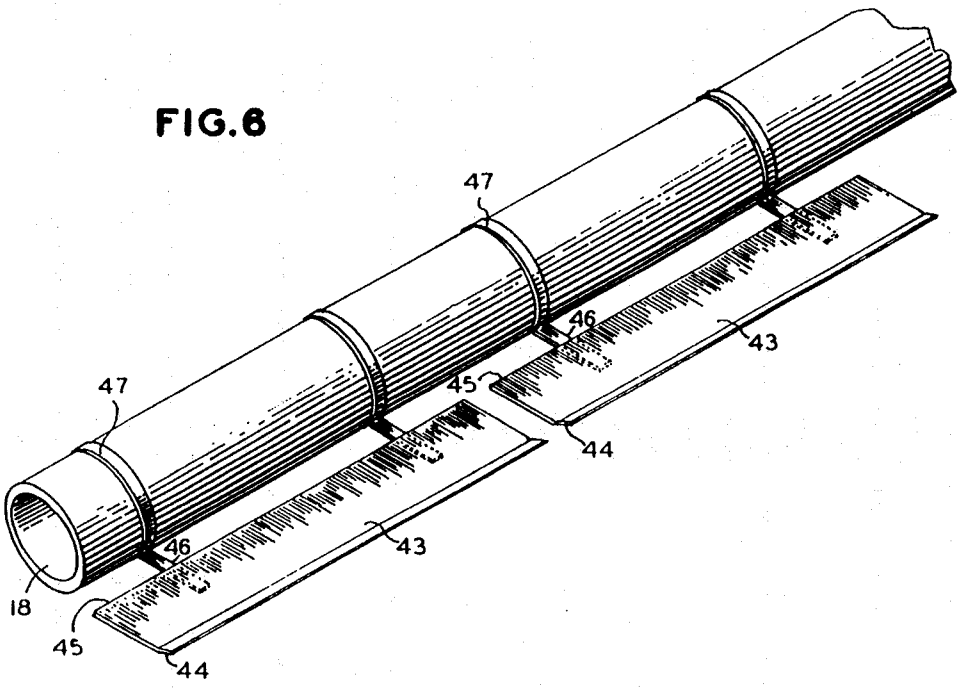
FIG. 6 is a perspective view of a tube equipped with more than one device of the present invention.

Turning now to FIGS. 3 and 6, a predetermined number of the convection tubes 18 are provided with a plurality of pivotable mounted devices 42 arranged in series which serve to prevent gas bypass of the tube bundle when devices 42 are in a first operating position and which, when retracted to a second position, permit easy removal of the tube bundle for furnace repair and the like. The number of tubes fitted with devices 42 is readily determinable by furnace designers and generally depends upon the number of vertical rows of horizontally disposed tubes used in the convection section of the furnace. Suffice it to say that at lease one and preferably a plurality of tubes are equipped with devices 42 of the present invention. Additionally, the tubes 18 fitted with devices 42 will be in a vertical row that is one row removed from the wall 16 of the furnace 10.

Figure 4:
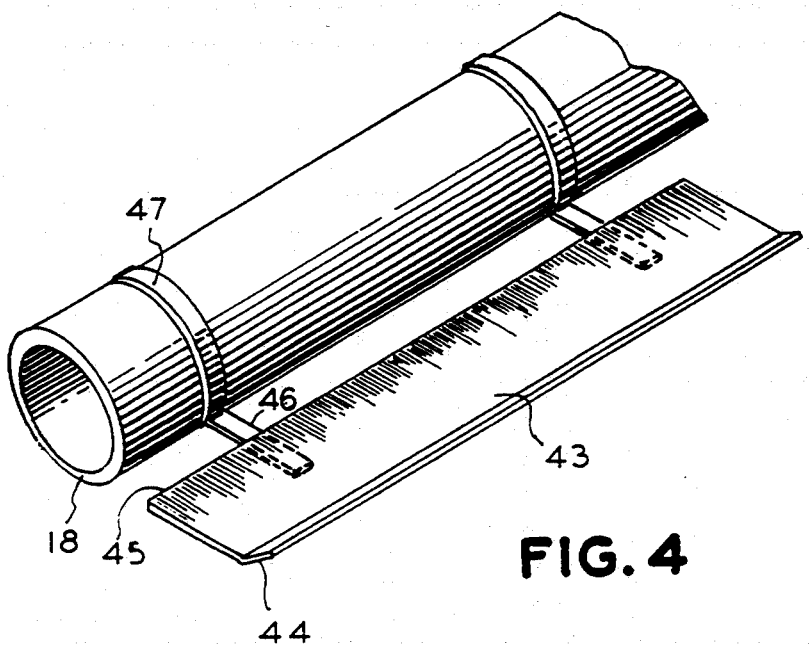
FIG. 4 is a perspective view of a tube equipped with a device shown in FIG. 3.

As can be seen in FIGS. 3 and 4, a device 42 comprises an elongated member 43 pivotably mounted to a convection tube 18. Preferably 43 will have a width such that member 43 will extend outwardly to the wall 16 from the tube 18 to which it is attached. As shown particularly in FIG. 4, member 43 has a first side 44 which preferably is beveled to provide better contact with the surface of refractory lining 16 and has a second side 45 which is a spaced apart at a predetermined distance from a tube 18. Also, in the embodiment shown in a FIGS. 3 and 4, the corbelling device 42 of the present invention is a pivotably mounted to tube 18 by means of rotatable clip 47 having a generally arcuate cross-section sized to be in slideable contact with the outer surface of tube 18 and including a projecting arm 46 for attachment to the elongated member 43. At least a pair of a such clip means 47 and arms 46 are provided for pivotably mounting member 43 on tube 18.

Optimally a single elongated device 42 would be provided and have a length substantially equal to that of convention tube 18. Practically, however, to accommodate tube supports and the like, a plurality of devices 42 are provided and arranged in series, the number of such devices being sufficient that the device extend for substantially the length of tube 18. Thus, FIG. 6 shows two devices 42 arranged serially on tube 18 and preferably spaced apart to provide for thermal expansion.

Figure 5:
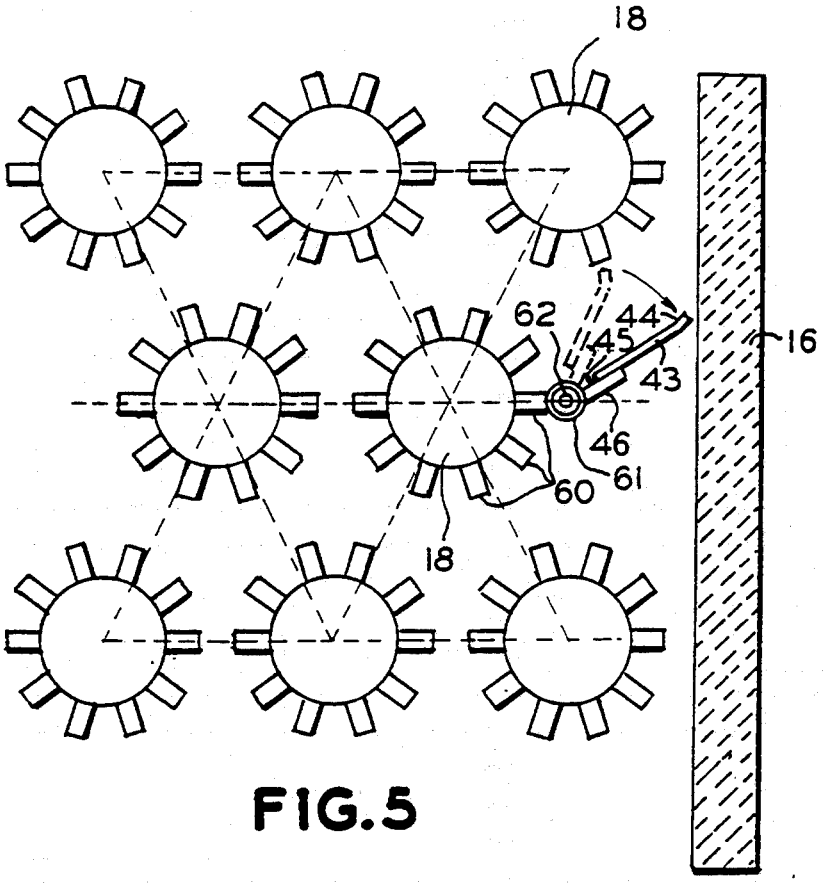
FIG. 5 is a detailed view of another embodiment of the device of the present invention.

Referring now to FIG. 5, there is shown a device of the present invention which is pivotably mounted by a hinge member to a tube 18 that includes an extended heat exchange surfaces 2 or tube studs 60. In this embodiment of the invention, the hinge member comprises a ring 61 that is a attached to a tube stud 60, for example by welding. Arm 46 includes a rod or axle adapted to be received by ring 61 thereby permitting movement of member 43 from a first position to a second position.

In use, the device is maintained in a first position, for example by tying or the like, for inserting or removing the tube bundle from the convection section 12 of the furnace. Because of the weight of the device, it will drop down into a second position upon removal of the securing means. This can be done, of course, mechanically or by merely permitting the securing mechanism to be burned during the startup of the heater.

Although several preferred embodiments of the invention have been illustrated and described in detail, it should be readily apparent that various changes may be made in the disclosed embodiment without departing from the scope or spirit of the invention.

What is claimed is:

1. In a fired heater having walls defining a convection section including a tube bundle comprised of a plurality of vertical rows of horizontally disposed heat exchange tubes spaced apart from the walls, the improvement comprising:

a plurality of elongated plate members pivotably mounted on at least one horizontal tube in a vertical row that is one row removed from the wall, each elongated plate member sized longitudinally to extend at a predetermined distance from the tube to the sidewall when in a first position, thereby preventing gas from channelling between the tubes and sidewall and wherein the plate member is positioned in an upwardly extending second position for introducing and for removing the tube bundle, the elongated plate members being arranged in series in sufficient numbers to extend for substantially the length of the tube.

2. The device of claim 1 wherein each plate is mounted on the tube by at least two mounting members, the mounting members comprising a first part of arcuate cross section sized to fit over and in slideable engagement with the tube and an arm connected to and extending outwardly from the first part and connected to the plate member.

3. The device of claim 1 wherein the tube includes outwardly projecting studs and each plate member is pivotably mounted to the stud by means of at least two hinges.

4. The device of claim 3 wherein the hinges comprise a ring connected to a stud and adapted to receive a rod connected to an arm extending from the plate member.

* * * * *